US005702502A

United States Patent [19]

Kundrat et al.

[11] Patent Number: 5,702,502

[45] Date of Patent: Dec. 30, 1997

[54] METHOD FOR DIRECT USE OF CHROMITE ORE IN THE PRODUCTION OF STAINLESS STEEL

[75] Inventors: David M. Kundrat, Cincinnati; Allan M. Smillie, Middletown; Richard C. Sussman, West Chester, all of Ohio

[73] Assignee: Armco Inc., Middletown, Ohio

[21] Appl. No.: 573,316

[22] Filed: Dec. 14, 1995

[51] Int. Cl.[6] ..... C21B 15/00; C21C 7/00; C22B 4/04; C22B 9/00

[52] U.S. Cl. ..... 75/501; 75/503; 75/540; 75/623; 75/708; 420/116

[58] Field of Search ..... 75/501, 503, 540, 75/623, 707, 708, 508, 543; 420/116

[56] References Cited

U.S. PATENT DOCUMENTS

| | | | |
|---|---|---|---|
| 4,427,186 | 1/1984 | Buhrmann | 266/225 |
| 4,565,574 | 1/1986 | Katayama et al. | 75/130.5 |
| 4,572,747 | 2/1986 | Sussman et al. | 148/3 |
| 4,961,784 | 10/1990 | Tanabe et al. | 75/623 |
| 5,302,184 | 4/1994 | Batterham et al. | 75/501 |
| 5,567,224 | 10/1996 | Kundrat | 75/414 |
| 5,609,669 | 3/1997 | Brunner | 75/548 |

FOREIGN PATENT DOCUMENTS

| | | |
|---|---|---|
| 330483 | 2/1989 | European Pat. Off. . |
| 117852 | 7/1983 | Japan . |

OTHER PUBLICATIONS

Masterson, I.F., "Argon Oxygen Decarburization (AOD)", ASM Handbook, v15. pp. 426–429, Sep. 1988.

Burgmann, W., "Vacuum Oxygen Decarburization (VODC)", ASM Handbook, v15. pp. 429–431, Sep. 1988.

Aplan, F.F., "Chromium", SME Mineral Processing Handbook, v2. pp. 27–4—27–6, 1985.

*Primary Examiner*—Melvyn Andrews
*Assistant Examiner*—J. A. Lorengo
*Attorney, Agent, or Firm*—Robert J. Bunyard; Larry A. Fillnow

[57] ABSTRACT

A three-stage process for obtaining metallic Cr units insitu during the production of stainless steel. Raw chromite ore or a concentrate produced from chromite ore is mixed with a carbonaceous reductant and slagging agents are added to an iron bath (24) for smelting and refining in a refining reactor (10). During the first stage, partially metallized chromite is smelted by carbon in the reactor that is top-and bottom-blown with oxygen and oxygen-containing gases respectively to produce a chromium alloy bath having a carbon content well below saturation. In the second stage, the alloy bath is decarburized by being bottom stirred with the oxygen-containing gas to the final bath carbon specification. In the third stage, the alloy bath is reduced by a metalloid reductant such as silicon or aluminum and again bottom stirred but with a non-oxidizing gas to achieve a high chromium yield. The reactor includes a top lance (18) extending through a throat (14) with a lower portion (20) of the lance extending to a point just above the bath and means (22) such as a tuyere or porous plug mounted at or near a bottom (16) and extending through a refractory lining (12) for stirring the iron bath containing dissolved carbon. Lance (18) includes a central passage (34) for injecting a compact, focused jet oxygen gas (30) that can penetrate through a slag layer (26) for decarburization of the iron bath and an outer passage (32) for discharging an oxygen gas (28) above the bath for post-combustion of CO to $CO_2$. Passage (32) includes a plurality of evenly spaced annular diverging nozzles (33). The lance also includes a pair of concentric conduits (36) and (38) for conducting a coolant.

43 Claims, 4 Drawing Sheets

METHOD FOR DIRECT USE OF CHROMITE ORE IN THE PRODUCTION OF STAINLESS STEEL

BACKGROUND OF THE INVENTION

The invention relates to a three-stage process for smelting and refining chromite ore to obtain chromium units during the manufacture of stainless steel. More particularly, an iron bath containing chromite ore, carbon and slagging agents is smelted and refined in a reactor producing an intermediate iron-chromium base alloy bath having a carbon content below carbon saturation. The chromium-alloyed iron bath subsequently is decarburized to specification, and any remaining chromium oxide is reduced to obtain a high chromium yield.

One prior art industrial method of manufacturing stainless steel is by melting chromium-containing scrap and ferrochromium in a melting furnace such as an electric are furnace, followed by decarburization while stirring the chromium-alloyed bath in a refining reactor. Typically, about 15 wt. % of the chromium is re-oxidized to the slag as the thermodynamic carbon activity of the bath is lowered. The decarburization step is followed by a reduction step, where a metalloid reductant such as silicon or aluminum is charged and high purity argon is injected to recover Cr units to the bath from the chromium oxide. This is followed by a ferrochromium trim addition to reach final alloy specification.

By ferrochromium is meant an alloy containing 20–70 wt. % chromium and 4–8 wt. % carbon, the balance essentially iron and impurities. The Cr units in ferrochromium are expensive due to reliance upon electricity and the high quality chromite concentrate used when manufactured by the conventional method. Metallurgical grade chromite is smelted with coke in a submerged electric arc furnace and then cast into chills. Efficient smelting requires that the charge be properly sized.

A recent innovation is the smelting of liquid ferrochromium from lower quality, chemical grade chromite or concentrate, which is subsequently added to an iron bath in a separate reactor for refining into stainless steel. U.S. Pat. No. 4,565,574 discloses a process for producing liquid ferrochromium in a top-and bottom-blown converter from pre-reduced and pre-heated carbon-containing chromite pellets. The pellets are prepared from powdered coke and chemical grade chromite ore. The pellets are charged into a rotary kiln, along with extra coke and time for pre-heating and partial metallization. The pellets then are charged hot to the converter, equipped with a propane-protected bottom-blown tuyere and a top lance through which oxygen is injected. The purpose of the lance is primarily to combust carbon monoxide (CO) from chromite reduction to carbon dioxide ($CO_2$), thereby delivering post-combustion heat into the slag layer protecting the metal bath. The heat balance is such that a significant degree of post-combustion (>30%) and corresponding heat transfer efficiency (>85%) are needed to ensure sufficient heat is available for the endothennic reduction of chromite by carbon to chromium and iron. Essential to sustaining a fast rate of reduction in the slag layer, about 20 wt. % of coke must be maintained in the slag. The presence of coke in the slag also minimizes foaming. While the presence of coke in the slag layer also helps minimize reoxidation of chromium from the bath to the slag, it has the unfortunate consequence of dissolving carbon from the coke into the bath up to the carbon saturation limit commensurate with the chromium content. A so-called hard stir is mandated to eliminate temperature differences between the slag and bath and to achieve sufficient kinetics of reduction. The degree of stirring is kept below that thought to result in excessive refractory lining wear.

U.S. Pat. No. 4,961,784 discloses a method for smelting raw chromite ore in a converter with top-bottom-and side-blowing capability. A liquid ferrochromium having about 18 wt. % Cr and 6 wt. % C is produced in about one hour. After molten iron is charged into the converter, raw chromite ore, coke and flux at ambient temperature are then added to the bath. A relatively large mount of sensible heat to bring the temperature of the charge materials to the bath temperature and a large heat of reaction for the highly endothermic reduction of chromite by carbon dictate a large total heat requirement. This is supplied principally from a high degree of post-combustion of CO from decarburization, at a high level of heat transfer efficiency. Oxygen for decarburization and ensuing post-combustion is injected through a top lance, whereas only CO and/or argon (Ar) or nitrogen ($N_2$) are injected into to the bottom and side tuyeres. The lance is submerged into a foamy slag containing substantial char for stabilization of the foam. The lance includes a nozzle design providing an oxygen jet for decarburization that penetrates the slag into the underlying metal bath and another oxygen jet that does not penetrate through the slag for post-combustion. In combination with the appropriate amount of side gas injection, the oxygen injection enables a post-combustion degree of at least 30% at a relatively high average heat transfer efficiency of 85% to be achieved.

Japanese patent application 58-117852 discloses a method of using a top-and-bottom-blown converter having side-blowing capability. Fine, raw chromite ore and coke arc charged into molten metal. However, unlike U.S. Pat. No. 4,961,784; oxygen is blown through all three ports and the top-injected oxygen is blown relatively softly. After the smelting period, a finishing period follows in which oxygen injection continues only through the top lance resulting in a carbon-saturated iron-chromium alloy having 20–32 wt. % chromium.

European patent application 330,483 teaches a method of producing a carbon-saturated iron-chromium bath from melting stainless steel scrap, followed by smelting partially reduced chromite pellets in a converter with top-and-bottom-blowing capability. Scrap, coke and molten pig iron are charged into the converter. Heat generated by decarburization of the pig iron melts the scrap. Flux is added to neutralize silicon dioxide ($SiO_2$) generated from silicon contained in the scrap and pig iron. After a period of about 30 minutes, partially reduced chromite pellets and a carbonaceous material are charged into the converter. Top-and bottom-blowing of oxygen ensues for about 45 minutes, producing a carbon-saturated bath containing about 15 wt. % Cr and 5.5 wt. % C. Use of expensive ferrochromium alloys is avoided.

U.S. Pat. No. 5,302,184 discloses a method for injecting an alloying-containing material, flux and a carbonaceous material directly into a metal bath to make liquid ferroalloys such as ferrochromium. Liquid iron is the smelting medium, which is agitated by injection of an oxygen-containing gas. The process can be continuous, where the objective is control of the oxygen potential entered into the system, depending upon the metal oxide to be reduced. This control is to be achieved by control of the relative rates of injection of the key components. Carbon content is maintained between 3–12 wt. % by addition or injection of a carbonaceous material. Oxygen also is injected to effect a very high degree of post-combustion, between 40–60%. Due to the high degree of post-combustion and agitation in the reaction chamber, droplets of metal are continuously exposed to a heat and oxygen source and undergo decarburization. These droplets fall back into the bath, transferring much needed heat and providing carbon-depleted metal, which then absorbs carbon upon contact with the carbonaceous material injected into the bath.

Nevertheless, there remains a need to provide inexpensive metallic Cr units directly from raw chromite ore or chromite ore concentrate during the production of stainless steel in the place of expensive ferrochromium. The physico-chemical and thermo-chemical processes involved in the above described prior art for the smelting of chromite ore have inherent limitations that may only be optimally suited to a particular set of demands. One key limitation is the production of a relatively high-carbon liquid ferrochromium. A high-carbon content at or near saturation of the ferrochromium produced to be refined directly into stainless steel requires either a lengthy decarburization step if it is the base alloy, or a larger melt shop if it is to be a master alloy feeding several refining reactors. Another important limitation is the high degree of post-combustion required for the heat balance. While this can be desirable to increase the energy efficiency of the process, it may not be the most economical. High post-combustion can result in excessive refractory wear and reliance on excess carbonaceous material to maintain an acceptable chromium yield, in mm resulting in a high-carbon product.

BRIEF SUMMARY OF THE INVENTION

A principal object of the invention is to produce inexpensive metallic Cr units from an inexpensive, chemical-grade raw chromite ore or chromite ore concentrate.

Another object of the invention is to reduce the chromite ore in a single refining reactor containing molten iron.

Another object of the invention is that at least 20% of the total metallic Cr units required in the specification for a stainless steel originate from the chromite ore.

Another object of the invention is that substantial metallic Cr units required in the specification for a stainless steel to be essentially from chromite ore with minor reliance upon expensive ferrochromium.

Another object of the invention is to provide metallic Cr units required in the specification of a stainless steel from chromite ore in about the same or marginally increased total melting, smelting and reduction time as that for conventional processing of stainless steel.

Another object of the invention is to integrate the chromite smelting and reduction process with an existing melting furnace for supplying molten iron with minimal capital investment.

Another object of the invention is for the chromite smelting and reduction process to be adaptable to a small-scale specialty or mini-mill melt shop by requiring minimal capital investment and marginally increased production time.

The invention relates to a process of reducing metal oxide to provide metallic Cr units during the production of a high chromium alloy bath for making stainless steel. The invention includes providing an iron/slag bath mixture within a reactor having means for stirring the iron bath. The iron bath contains dissolved carbon, oxygen-bound chromium and iron metal and accompanying slag constituents. An oxygen-containing gas is injected through the stirring means to effect decarburization and to vigorously stir the iron bath, slag, and oxygen-bound metal to form a chromium alloy bath. The oxygen content of the stirring gas is decreased as the carbon content of the alloy bath approaches its final carbon specification. A metalloid reductant then is charged into the reactor and a non-oxidizing gas is injected through the stirring means to rinse the alloy bath until dynamic equilibrium is sustained and chromium yield is maximized.

Another feature of the invention is for the reactor to include means for top-blowing of oxygen gas with a portion of the oxygen gas discharged above the iron bath to effect post-combustion of CO and $H_2$ and the remainder of the oxygen gas being injected into the iron bath to effect decarburization and generate CO.

Another feature of the invention is for the total gas passing through the blowing means and passing through the stirring means being at least 0.5 $NM^3$/min/MT.

Another feature of the invention is for 30 to 60% of the total gas flowing into the reactor to pass through the stirring means.

Another feature of the invention is for the post-combustion degree of CO and $H_2$ being less than 50%.

Another feature of the invention is for the aforesaid stirring gas to have an initial molar ratio of oxygen to non-oxidizing gas following post-combustion of 4/1 with the ratio being decreased to ⅓ by the end of decarburization.

Another feature of the invention is for the temperature of the iron bath prior to the oxygen-blow to be at least 1500° C.

Another feature of the invention is for the initial iron bath to contain at least 0.5 wt. % and up to carbon saturation.

Another feature of the invention is for the chromium alloy bath to contain 0.5–1.5 wt. % C and at least 2 wt. % Cr at the end of post-combustion.

Another feature of the invention is for the total chromium yield being at least 70% at the end of post-combustion.

Another feature of the invention is for the aforesaid oxygen-bound metal being from the group consisting of raw chromite ore, chromite ore concentrate, partially metallized chromite ore and chromium oxide dust.

Another feature of the invention is for the aforesaid oxygen-bound metal to be preheated to at least 1000° C.

Another feature of the invention includes adding a solid, carbonaceous reductant and slagging agents to the initial iron bath.

Another feature of the invention is for the carbonaceous reductant to include solid carbon of a quantity in excess of that required for pre-metallization of the oxygen-bound metal.

Another feature of the invention is for the slag weight during post-combustion, exclusive of $Cr_2O_3$ or FeO, not to exceed 400 kg/MT.

Another feature of the invention is to add a metalloid reductant to the initial iron bath.

Another feature of the invention is that at least 20% of the total metallic Cr units of the chromium-carbon alloy bath are derived from the chromite ore.

Another feature of the invention is for the initial iron bath to be melted in an electric arc furnace from solid ferrous materials from the group consisting of carbon steel scrap, stainless steel scrap and steel plant wastes.

Advantages of the invention include an economical process for producing stainless steel using inexpensive, chemical-grade chromite ore and concentrates, being able to smelt and refine the steel in the same refining reactor and minimizing reoxidation of chromium during decarburization of the iron bath. Another advantage is being able to produce stainless steel using stainless steel scrap and expensive ferrochromium alloy as a secondary source of metallic Cr units. An additional advantage includes integrating the process with an existing electric arc furnace in a smaller scale, specialty or mini-mill melt shop with minimal capital investment.

The above and other objects, features and advantages of the invention will become apparent upon consideration of the detailed description and appended drawing.

DETAILED DESCRIPTION OF THE PREFERRED EMBODIMENT

Figure 1:
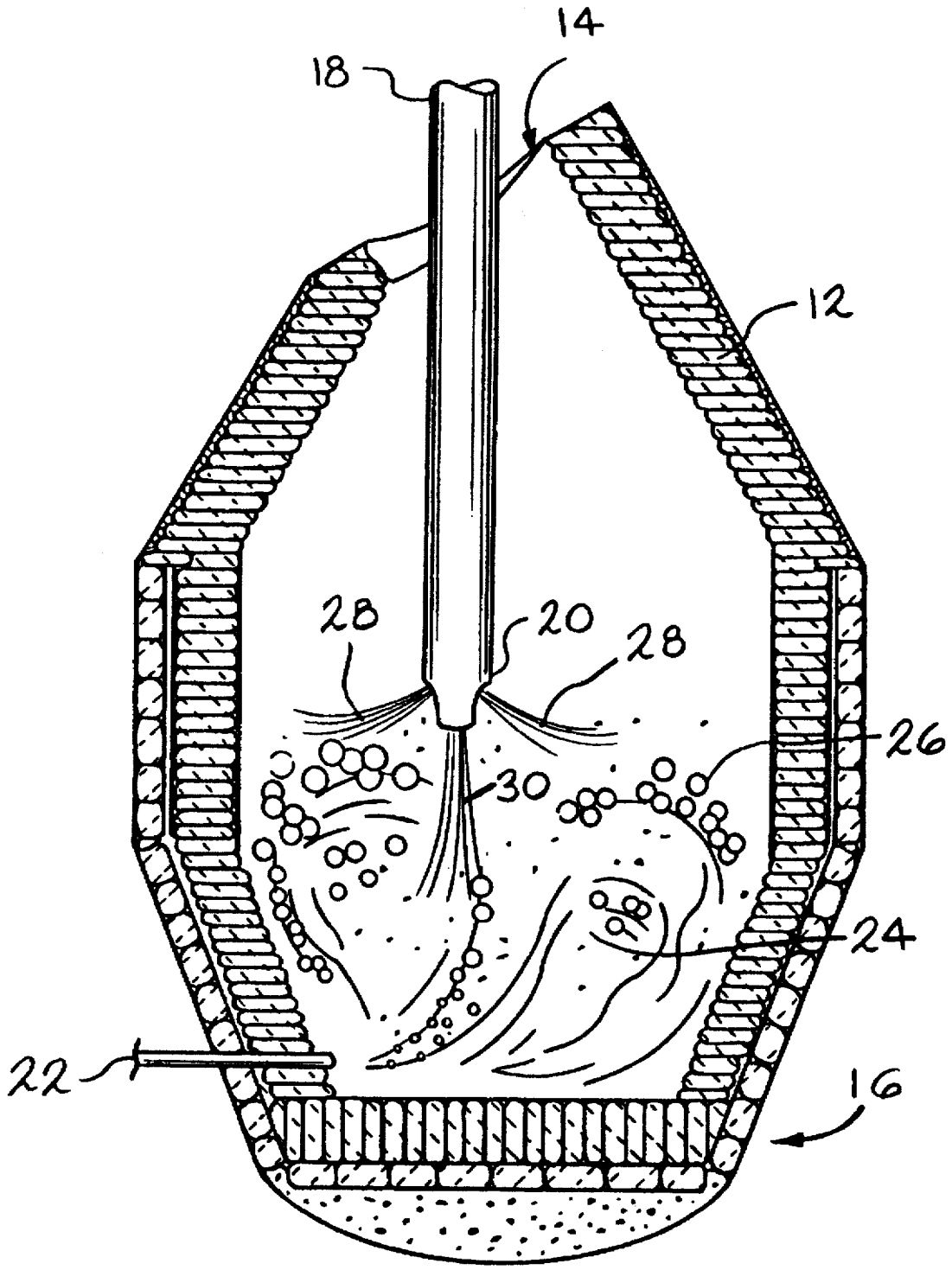
FIG. 1 schematically illustrates one embodiment of a reactor for use in the process of the invention, FIG. 2 schematically illustrates a lower portion of a lance of the reactor of FIG. 1 including one gas passage for discharging oxygen above an iron bath for post-combustion and another gas passage for injecting oxygen into the iron bath for decarburization.

An object of the invention is to derive the maximum metallic Cr units required when making a stainless steel from inexpensive sources of oxygen-bound chromium-containing metal or chromium oxides such as raw chromite ore, concentrate made from chromite ore, partially metallized chromite ore and chromium oxide-containing steel plant wastes. To this end, as much as 90% of the metallic Cr units may be derived from chromite ore when making stainless steel AISI grade such as 409 and 50% of the Cr units when making AISI Grades 304 and 439. It will be understood that some portion of the Cr units required of the stainless steel specification may be acquired from chromium-containing charge materials such as stainless steel scrap. It will be further understood a minor amount of ferrochromium alloy may also, be used as a final trim addition to adjust the bath specification to that required of the final alloy specification.

The invention relates to a three-step process for producing stainless steel directly from an oxygen-bound chromium metal. After being heated in an iron bath, the oxygen-bound chromium metal is at least partially smelted in a well-stirred iron/slag bath to a low- or medium-carbon content and to an intermediate chromium yield. The chromium-alloyed bath then is decarburized to the final bath specification. Since a portion of the oxygen-bound chromium metal remains during smelting, an important advantage of the process of this invention is that reoxidation of chromium in the bath during decarburization is minimized. Thereafter, the chromium-alloyed bath is further reduced with a metalloid reductant to obtain high chromium yields at low-carbon contents by recovering metallic Cr units from chromium oxide. The smelting, decarburization and reduction occur in the same refining reactor. The entire process can be carried out in a melt shop equipped with a melting furnace such as an electric are furnace and a refining reactor preferably retrofitted with means for top-blowing of oxygen gas such as an argon-oxygen-decarburizer or a vacuum-oxygen-decarburizer, thereby reducing capital expenditures.

An advantage of the present invention is to provide an economical process for making stainless steels in a refining reactor using less expensive chromite ores and concentrates substituting in part for relatively more expensive ferrochromium and stainless scrap. More specifically, partially reduced preheated chromite is smelted in an iron bath, which is refined directly to stainless steel in the same reactor. The process of the invention is such as to be economically implemented in an existing stainless melt shop having a reactor preferably retrofitted with a top-blowing means such as a lance in an Argon-Oxygen-Decarburizer (AOD), a Vacuum-Oxygen-Decarburizer (VOD) or a Crusot-Loire-Uddeholm (CLU) converter, or having installed a generic Top-and-Bottom-blowing-Refining-Reactor (TBRR).

The basis of the present invention is exploitation of the mixing capability of the AOD, VOD, CLU, or TBRR to facilitate fast reduction of chromite ore, a normally difficult-to-reduce metal oxide. Carbon is the principal reductant in the early stage of smelting. Any one of the metalloids of silicon (Si), aluminum (Al), titanium (Ti), magnesium (Mg) or calcium (Ca) can be a co-reductant in the early stage of smelting and the only reductant in the final stage of reduction. Si, Al or a mixture thereof are the preferred metalloid reductants.

The heat deficit normally incurred in smelting chromite ore by carbon preferably is met by a combination of the following steps: pre-heating and partial metallization of the chromite charge, post-combustion of the smelting product gases, e.g., CO, and/or addition of a metalloid reductant. When metalloid reductants such as Si and Al are the reductants during the final reduction, the heat generated by the exothermic reactions contributes significantly to the heat balance and is the only heat source needed. In the early stage of partial smelting when ample oxygen is injected, the heat generated by combustion of the metalloids with oxygen and the exothermic reduction of chromite can compensate for one or a combination of post-combustion, or pre-heating of the charge or partial pre-metallization of the chromite. However, an economic penalty can be incurred, since metalloids such as Si and Al are more expensive as reductants per weight of chromium reduced than carbon. In addition, their use, particularly in the early stage of smelting depending upon the pre-metallization degree, substantially can increase the slag weight, ultimately limiting the chromite charge weight per tonne of alloy produced. In the present invention, the primary reductant is carbon with metalloids possibly assisting in the first stage depending upon the heat balance. These metalloids, however, must be used in the final stage of smelting to improve the chromium yield in the absence of injected oxygen. In the final reduction stage, despite the absence of injected oxygen for combustion of the metalloids, the exothermic reduction of chromite by metalloids is generally sufficient to offset the heat requirements, namely heat losses and sensible heat of an inert stirring gas.

The process of the invention includes three distinct stages which occur consecutively in a refining reactor 10 such as a TBRR schematically illustrated in FIG. 1. The reactor includes a refractory lining 12, a top end or throat 14, a lower end or bottom 16, oxygen-blowing means such as a top lance or pipe 18 extending through throat 14 of the reactor with a lower portion 20 of the lance extending to a point just above the bath and means 22 such as a tuyere or porous plug mounted at or near bottom 16 of the reactor and extending through the refractory lining for stirring an iron/slag bath mixture 24 containing dissolved carbon. The iron bath may be covered by a thin slag layer 26, depending upon slag weight.

Figure 2:
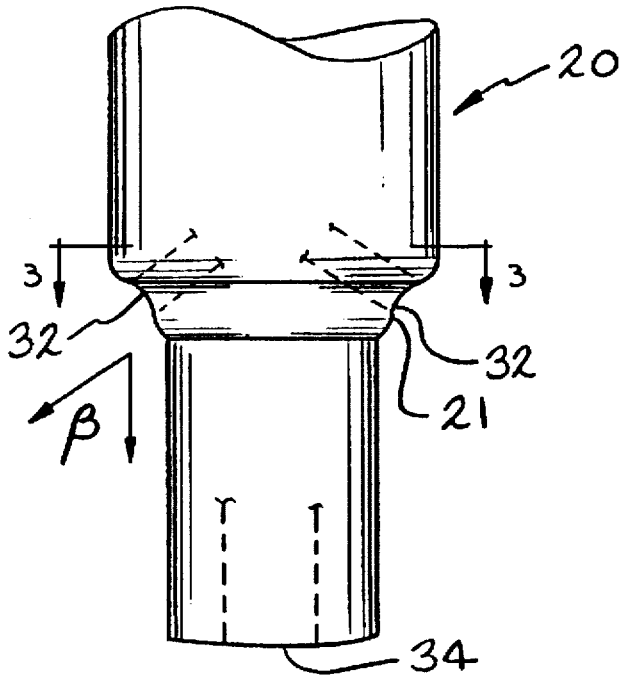

The process of the invention now will be more fully described. An oxygen-bound chromium metal such as pre-heated, pre-metallized chromite ore along with a carbonaceous reductant and slagging agents are charged into the reactor through throat 14. Lower portion 20 of lance 18 then is lowered into the reactor but not into iron/slag mixture 24 to inject oxygen gas into the reactor. The oxygen gas preferably will be essentially pure oxygen. If the reactor does not include lance 18, a metalloid reductant such as silicon must be added along with the carbonaceous reductant and slagging agents to provide on oxidation and on reduction of chromite necessary heat. FIG. 2 illustrates lance 18 preferably including a pair of passages having a common oxygen supply (not shown) so that the rate of oxygen gas flowing through one of the passages and being injected into bath 24 can be independent of the rate of oxygen gas simultaneously flowing through the other passage for post-combustion of CO to $CO_2$. Post-combustion of carbon monoxide from the chromite reduction to carbon dioxide is necessary to deliver heat into the slag layer and iron/slag bath to ensure sufficient heat is available for the endothermic reduction of chromite by carbon to chromium and iron. An oxygen gas 30 flowing through a central passage 34 is a compact, focused jet that can penetrate through slag layer 26 and into bath 24 for decarburization of the molten iron. An oxygen gas 28 flowing through another passage 32 is dispersed over and above iron/slag bath 24 for post-combustion of CO to $CO_2$ for supplying auxiliary heat to the molten iron. Stirring means 22 is adapted for injecting an oxygen-containing gas and a non-oxidizing gas. The oxygen-containing portion of the stirring gas may include air, oxygen-enriched air, pure oxygen, water, steam or a combination thereof as well as Ar, $N_2$ or a mixture thereof. Stirring means 22 may include one or more concentric tubes with the oxygen-containing gas being flowed through an inner tube and a methane gas being flowed through an outer tube. The methane gas functions to cool the tuyere. With continued bottom gas injection, on disintegration and melting of the charge materials, a turbulent mixing of slag, molten iron and chromite grains is created. While the pre-reduced chromite, slagging agents and residual carbon all dissolve on contact with the hot iron/slag bath, unreduced chromite in the charge will exist as small, solid grains dispersed in the slagmetal mixture.

Figure 3:
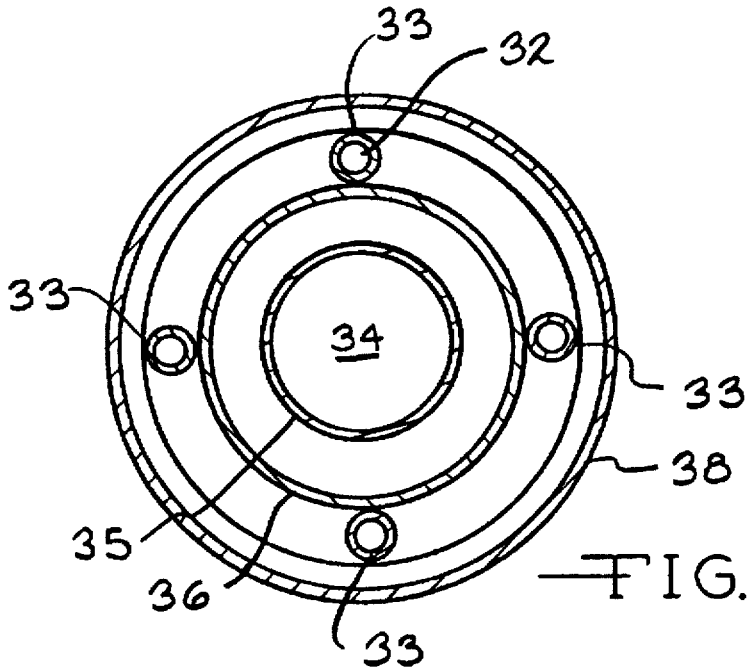
FIG. 3 illustrates a section view taken along line 3—3 of FIG. 2 the gas passages for discharging oxygen into the reactor, FIG. 4 schematically illustrates wt. % bath Cr during conventional smelting and refining of stainless steel, FIG. 5 schematically illustrates wt. % bath Cr during the smelting and refining when making stainless steel in accordance with the present invention.

FIG. 3 illustrates central passage 34 for injecting oxygen into the bath being a metal pipe 35. Outer passage 32, for discharging oxygen above the bath, includes four evenly spaced annular nozzles 33 diverging outwardly at an angle f3 (FIG. 2) of about 45° relative to the central axis of lance 18. Nozzles 33 terminate in a conical transition section 21 of reduced thickness in lower portion 20 of lance 18. Lance 18 additionally includes a pair of concentric conduits 36 and 38 for conducting a coolant through the lance. To obtain good post-combustion, the interaction of oxygen gas 30 passing through nozzles 33 and oxygen gas 28 passing through pipe 35 should be minimized. To this end, oxygen gas 28 passing from nozzles 33 should diverge downwardly but away from the central axis of the vertical lance at an angle β of at least about 30°. On the other hand, to reduce the velocity of the oxygen toward the inner wall of the reactor, angle β should not exceed about 60°. The flow rate of oxygen gas 30 through nozzles 33 preferably is controlled independently of the flow rate of oxygen gas 28 flowing through pipe 35. It will be understood more than four nozzles 33 or one pipe 35 can be used depending upon the oxygen flow rate requirements or the reactor size.

Melting and dissolution of the charge materials, partial smelting of chromite by carbon and generation of heat by decarburization and post-combustion are the key events of Stage 1. Depending on the pre-metallization degree of the chromite, smelting proceeds to a Cr yield of at least 70%, possibly as high as 85% or higher, while the temperature of the bath remains essentially unchanged from its initial temperature. The initial temperature of the iron bath can range from about 1500° C. to about 1750° C., preferably 1600° to 1650° C. The temperature is preferred to be below 1750° C. because of the cost associated with excessive refractory wear in the TBRR.

The oxygen-bound chromium metal of the invention may be raw chromite ore, concentrate made from chromite ore and chromium oxide-containing steel plant wastes. By chromite ore or chromite concentrate is meant a metal oxide containing between 25–55 wt. % $Cr_2O_3$ and the balance FeO, MgO, $SiO_2$, $Al_2O_3$ and CaO. The weight ratio of Cr/Fe preferably is between 0.9 and 3.5, more preferably 1:5 to 2.0. If the chromite is not partially metallized, the average size of the chromite grains preferably should be below 50 mesh to decrease smelting time. Concentrate sized below 100 mesh preferably should be injected to avoid excessive loss of fines. If the chromite is to be pre-metallized, the ore should be pulverized to a grain size of −200 mesh prior to agglomeration. By chromium oxide-containing steel plant wastes is meant furnace dusts, pickling sludge, rolling mill scale and the like.

If raw chromite ore in lump form or coarse concentrate is used, the chromite may be mixed with a solid, carbonaceous reductant and slagging agents, and charged loose into the reactor. Alternatively, the chromite ore may be pulverized and agglomerated as sinter or pellets or injected directly into the slag/iron bath. If agglomerated, the solid carbonaceous reductant and slagging agents preferably would be mixed with the pulverized chromite grains and combined into the sinter or pellets. Unmetallized sinter or pellets at ambient temperature (25° C.) may be pre-heated and partially metallized such as in a rotary hearth furnace, or a rotary kiln, or similar furnace capable of solid-state reduction of chromite by solid carbon for partially pre-metallizing the chromite grains by the accompanying carbonaceous reductant. If pre-metallized, the sinter or pellets preferably will be charged while still hot, immediately after being removed from the reduction furnace into the reactor at a temperature up to about 1200° C. after transport to the TBRR. The discharge temperature in the reduction furnace should not exceed about 1400° C. because of damage to the refractories in the reduction furnace. Preferably, a pre-metallized, pre-heated chromite-carbon-slagging-agent mixture is charged into the reactor with the chromite having a chromium metallization of at least 10%, an iron metallization of at least 50% and at a temperature of at least 1000° C.

By carbonaceous reductant is meant a predominantly solid, carbon-containing material. This carbonaceous reductant may accompany the pre-metallized chromite in excess of that required for the pre-metallization process, or may be charged separately to the iron bath in the reactor as in the case where the chromite is unmetallized. If the molten iron is provided upstream of the reactor in a melting furnace such as an Electric Are Furnace (EAF), the carbonaceous reductant may be charged partially or completely in the EAF. Suitable carbonaceous materials include coke, coke breeze, petroleum coke, charcoal, graphite, low-to-medium volatile bituminous coals and anthracite coals. Depending upon the solid iron materials used to produce the iron bath, it will be understood that the initial iron bath may contain sufficient dissolved carbon for smelting of the chromite in Stage 1 and it may not be necessary to add a carbonaceous reductant to the bath in the reactor.

Suitable slagging agents to be used in the invention include CaO, MgO, $Al_2O_3$ $SiO_2$ and $CaF_2$. One or more slagging agents may be added to the iron bath in the refining reactor, upstream in a melting or smelting furnace, or upstream such as during pelletization of the chromite. Use of slagging agents is preferred to maintain a preferred slag basicity and a preferred slag ratio of $MgO/Al_2O_3$, depending upon the chromite source and the extent of using silicon or aluminum as reductants.

The iron bath may be formed in a blast furnace or any other iron smelting unit capable of providing liquid iron from solid iron-containing materials, including iron oxides. Alternatively, the iron bath may be formed by melting solid, iron-bearing scrap and the like, either within the refining reactor or preferably upstream of the reactor within a melting furnace, such as an EAF. Suitable solid, iron-bearing scrap for forming the iron bath include carbon steel scrap, stainless steel scrap, iron carbide, direct reduced iron (DRI) or hot-briquetted iron (HBI). In the case where the iron bath is produced by melting scrap in an EAF, the carbonaceous reductant and slagging agents may in part or totally be dissolved or melted into the iron bath while the iron bath is still in the EAF prior to being transferred to the reactor. Depending upon the furnace and type iron-bearing materials used, the initial iron bath may contain 0–15 wt. % Cr, 0.5 wt. % C and up to carbon saturation.

All three stages of the invention now will be fully described in detail.

Stage 1

During Stage 1 of the process of the invention, an iron bath at a temperature of at least 1500° C. is provided within a refining reactor. Chromite ore is pulverized and mixed with excess solid carbon and slagging agents. The mixture is agglomerated into pellets and the pellets are partially metallized in a rotary hearth furnace as described in U.S. Ser. No. 08/470311, filed Jun. 6, 1995, entitled "Method Of Reducing Metal Oxide In A Rotary Hearth Furnace Heated By An Oxidizing Flame", incorporated herein by reference. After being pre-reduced to at least 10% chromium and 50% iron metallization, the pellets are charged through the throat of the reactor while at an elevated temperature of at least 1000° C., preferably at least 1200° C. Oxygen gas is blown through the lance, and an oxygen-containing gas is injected through the stirring means having a total flow rate between 0.5 and 4 $NM^3$/min/MT, preferably at least 2 $NM^3$/min/MT, more preferably at least 3 $NM^3$/min/MT. The percentage of the total gas flowing into the reactor through the stirring means is between 30 and 60%. The gas injected through the stirring means includes a non-oxidizing gas wherein the ratio of $O_2$/non-oxidizing gas is between 2 and 4. If the reactor is a CLU converter, the oxygen-containing gas may include steam because on reacting with carbon dissolved in the iron bath $H_2$ formed from $H_2O$ reduces the partial pressure of CO and can be substituted mole for mole for Ar. If the reactor is a VOD, for Stage 1, the reactor is operated much like a AOD where oxygen is blown through a top lance and through a bottom tuyere accompanied by an inert gas. Acceptable non-oxidizing gases include inert gases such as Ar or $N_2$, with Ar being preferred. Passing of oxygen through the lance serves two functions: to provide oxygen for decarburization and oxygen for secondary, or post-combustion degree of CO and $H_2$ evolving from the bath. Both combustion reactions supply heat to the iron bath, with post-combustion generating over twice as much heat as decarburization per unit of oxygen consumed. The Post-Combustion Degree (PCD) is defined for the gas leaving the reactor as:

$$100\times(\%\ CO_2+\%\ H_2O)/(\%\ CO+\%\ CO_2+\%\ H_2+H_2O)$$

In Stage 1, PCD is less than 50%, preferably between 20 and 30% when employed as a heat source. The total amount of oxygen gas as pure $O_2$ to be supplied to the iron bath is calculated based on heat and mass balances. The nozzle of the lance is designed to direct simultaneously a portion of the oxygen gas over and above the bath via a wide jet specifically to effect post-combustion, and the remaining portion of the oxygen gas, into the bath via a compact jet specifically for bath decarburization. The desired PCD of the waste gas is obtained by adjusting the shape of the nozzle affecting mainly the angle of the wide jet and its momentum, as well as the height of the nozzle above the bath. It is important that the nozzle of the lance not be positioned into or through the iron/slag mixture to insure that a portion of the oxygen gas blown through the lance is combusted above the iron bath.

The portion of heat generated by post-combustion, at a given PCD, that is actually captured or transferred to the bath, excluding that lost to the freeboard and to the evolving gas is referred to as its Heat Transfer Efficiency (HTE). An important feature of the invention is for the lance not be submerged into the bath to insure post-combustion occurs above the bath. Significantly less heat is able to be captured or transferred into the bath than if the lance were submerged. As a result, HTE of the present invention likely will be 50% or less. This is in contrast to HTE achieved on the order of 80 to 90% when the lance is submerged. Submerging the lance necessitates the ample presence of solid carbon to prevent significant reoxidation of Cr and Fe from the chromium alloy bath to the slag and to prevent slag foaming. Stage 1 is continued, i.e., passing of the oxygen gas through the lance accompanied by bottom-injection of oxygen-containing gas, until the bath carbon content drops to no more than 1.5 wt %, preferably less than 1.0 wt. % C, more preferably less than 0.7 wt. % and most preferably to as little as 0.5 wt. %. At this time, the Cr yield of the total chromium should be at least about 70% and the chromium alloy bath should contain at least 2 wt. % Cr and have a temperature no greater than 1750° C. More preferably the Cr yield should be at least about 70% and the chromium alloy bath should contain at least 5 wt. % Cr and most preferably the Cr yield should be at least about 85% and the chromium alloy bath should contain at least 8 wt. % Cr.

Another important feature of the invention is controlling the composition of the slag basicity and ratio of $MgO/Al_2O_3$. Slag basicity is defined as the weight ratio of (% CaO+% MgO)/% $SiO_2$. This slag basicity should be at least 1.0, preferably at least 1.5, more preferably at least 2.0 and most preferably at least 2.5. A higher slag basicity is known to reduce the equilibrium concentration of Cr in slag thereby increasing chromium yield. Slag basicity, however, should not exceed about 3.0 because the slag becomes too viscous at high concentrations of CaO and MgO due to increasing liquidus temperature. $Al_2O_3$ present in the slag preferably should range from 15 to 25 wt. %. Likewise MgO should range between 10 and 20 wt. %, and the ratio $MgO/Al_2O_3$ should be between 0.3 and 0.8.

Another important feature of the invention is to control the specific slag weight as kg slag/MT metal. If the slag weight becomes excessive, effective mixing of the slag becomes very difficult. The slag weight, excluding chromium oxide accumulated therein in Stages 1 and 2, should not exceed 400 kg/MT metal, preferably should not exceed 350 and more preferably should not exceed 300. Generally, the slag is entrained into the bath during the vigorous mixing action of injection of gas through the bottom tuyere. As slag weight increases much above 300 kg/MT metal, a significant portion of the slag can coalesce as a slag layer, where the absence of mixing in the layer inhibits reduction kinetics and transfer of post-combustion heat. As a result, the slag weight can limit the amount of chromite ore charged for a given chromium chemistry.

Stage 2

During Stage 2 of the process of the invention, the bath is decarburized to near the desired carbon specification for the grade of stainless steel being produced. The beginning of this stage is marked by ceasing passing of the oxygen gas through the lance and the onset of reduced injection of oxygen-containing gas through the stirring means. The decarburization procedure in an AOD requires that a non-oxidizing gas, such as an inert gas like Ar, be included with the oxygen-containing gas, wherein the ratio of $O_2$/Ar is systematically decreased. That is, the flow rate of inert gas relative to the flow rate of oxygen is increased. This procedure in the AOD preferably begins at a ratio of $O_2$/Ar of about 4/1, which is decreased stepwise or continuously to a ratio of 1/1 over a 15 to 30 minute period. The chromium alloy bath is sampled, then the decarburization stirring is continued, if necessary, for up to about another 10 minutes at a ratio of $O_2$/Ar of 1/3. Carbon steel scrap or stainless steel scrap may be added as a coolant if needed to offset heat generation by decarburization after compensating for heat losses and sensible heat of the stirring gas, so as to maintain approximately constant bath temperature, preferably in the range of 1600° to 1650° C. If the reactor is a VOD, the stirring means is effected by a large drop in pressure. Dissolved oxygen becomes supersaturated and reacts with residual carbon forming CO thereby decarburizing the bath. The bath thus becomes stirred by vigorously evolving CO.

Figure 4:
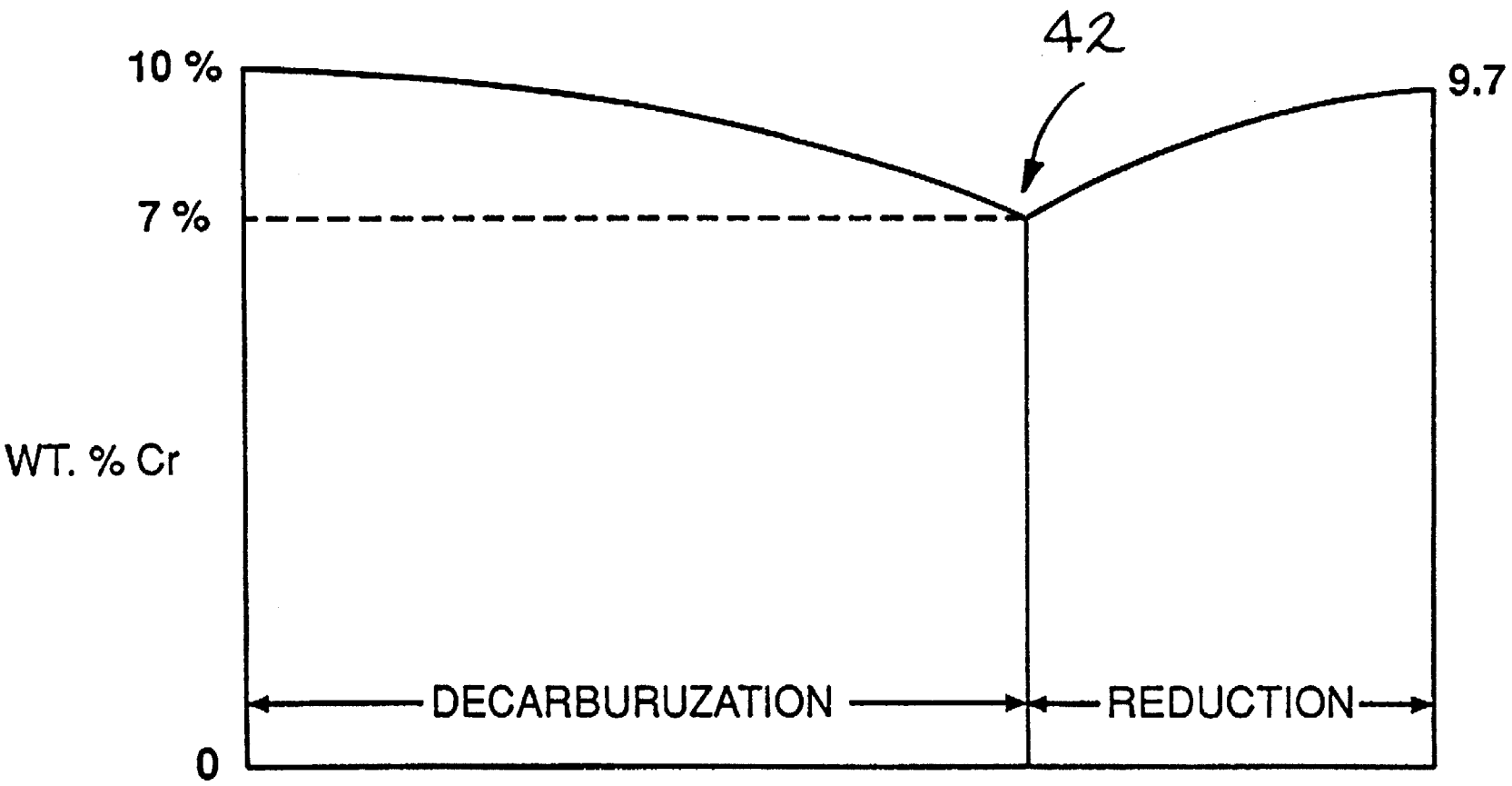
FIG. 4 PRIOR ART

Another important feature of the present invention is the absence of significant re-oxidation of chromium to the slag during Stage 2. During conventional decarburization of a chromium-alloyed bath produced from ferrochromium and stainless steel scrap, as carbon contents decrease, chromium and iron oxidize to the slag as $Cr_2O_3$(s), $FeO.Cr_2O_3$(s), CrO(l) and FeO(l). This re-oxidation is the result of an increase in the partial pressure of oxygen controlled by the carbon-oxygen equilibrium in the bath as the thermodynamic carbon activity is decreased during decarburization despite a lower partial pressure of CO. Typically, at least 10% and as much as 30% of the chromium in the chromium alloy bath can re-oxidize in this manner, causing the chromium yield at this point to decrease significantly. An important disadvantage inherent in prior art processes is illustrated schematically in FIG. 4. That is, as decarburization continues, the content of Cr in the bath may decease from, say, about 10 wt. % down to as a low as 7 wt. % at numeral 42.

Figure 5:
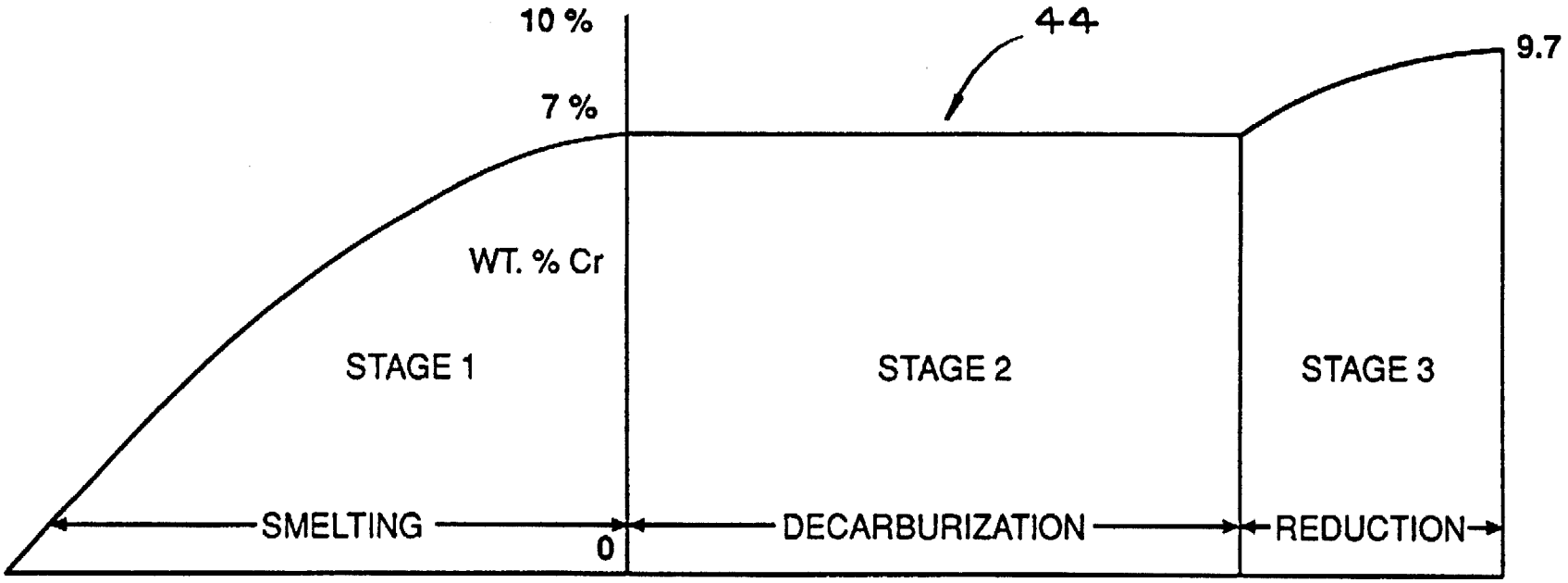

By contrast in the present invention, significant re-oxidation of bath chromium to the slag is circumvented by the presence of unreduced chromite from Stage 1. Its presence maintains a higher thermodynamic activity of $FeO.Cr_2O_3$(s) as well as $Cr_2O_3$(s) and CrO(l) in the slag, thereby reducing the driving force to re-oxidize chromium despite the higher oxygen partial pressure at the end of decarburization. This is illustrated schematically as numeral 44 in FIG. 5, i.e., the invention. This also is true in the case where the reactor is a VOD wherein the partial pressure of CO is reduced by vacuum rather than by dilution with Ar. Despite a lower partial pressure of CO by vacuum in the VOD, as the thermodynamic activity of carbon is decreased the activity of $Cr_2O_3$ tends to increase. As in the AOD, the presence of unreacted $FeO.Cr_2O_3$ from Stage 1 tends to maintain a high activity of $Cr_2O_3$, thereby minimizing additional oxidation of chromium. A limited amount of re-oxidation may occur at the end of decarburization in Stage 1 of the invention. Similarly, a limited amount of smelting of chromite by carbon may occur early in Stage 2 of the invention. As a result, chromium yield remains approximately the same as at the end of Stage 1 and approximately that normally encountered at the end of decarburization in the routine practice of refining stainless steel.

Stage 3

Stage 3 of the process of the invention also is a reduction stage, but wherein one or more of the metalloids Si, Al, Ti, Mg, or Ca are the reductants rather than carbon. Also, a non-oxidizing gas such as Ar, preferably high-purity Ar, is injected through the stirring means to effect vigorous mixing on contact of the reductant dissolved in the chromium alloy bath with the various oxides of chromium and iron. These oxides reduce to dissolved metal, increasing chromium yield generally to beyond 95%, depending on the chromium-chromium oxide equilibrium or quasi-equilibrium. Maximum transfer of chromium from the slag to the metal is achieved under conditions of vigorous mixing of the metal and slag at a high basicity where equilibrium is attained. By quasi-equilibrium is meant the molten iron-slag interfacial movement is sufficient to result in a dynamic balance between the iron bath and the slag containing the chromium oxides, resulting in chemical and thermal equilibrium being closely approached between the iron and slag.

Reduction of chromite by these metalloid reductants is exothermic, offsetting heat losses and the sensible heat requirement of the stirring gas. Thermal adjustments to the bath can be made by adding coolants such as steel scrap or any required trim additions needed. The trim additions may include small amounts of stainless steel scrap or ferrochromium to meet the final chromium specification.

Pilot Trials Of The Invention

Molten iron was charged into a pre-heated, ½ tonne pilot reactor equipped with a commercial porous plug through which argon was flowing. Iron was melted in a 550 kg capacity air induction furnace and tapped through a tundish into the reactor. The heats were tapped as hot as possible, typically 1700° to 1750° C., to overcome the relatively high thermal losses due to small heat size and large sensible heat requirement of the charge materials. With a D-Cast working lining and an alumina back-up lining in the pilot reactor, heat losses through the walls and open top mounted only to 9° C./min. The capability of the reactor used for the pilot trials of the invention was limited to only the bottom stirring means, thus not allowing the option of decarburization and post-combustion from blowing oxygen from a top lance.

Partially metallized chromite pellets containing carbon, and slagging agents were charged cold into the reactor containing the molten iron. Table I characterizes the pellets, where subscripts "t" and "m" refer to "total" and "metallized".

TABLE I

| % $Cr_t$ | % $Cr_m$ | % $Cr_m$/% $Cr_t$ | % $Fe_t$ | % $Fe_m$ | % $Fe_m$/% $Fe_t$ | % C |
|---|---|---|---|---|---|---|
| 30.4 | 16.5 | 0.54 | 19.7 | 17.4 | 0.88 | 4.7 |
| % $Al_2O_3$ | % MgO | % $SiO_2$ | % CaO | % P | % S | |
| 15.9 | 11.4 | 7.6 | 0.3 | 0.004 | 0.15 | |

After the charge was made, the bath and slag were sampled and temperature taken every two to three minutes for the duration of the trial. Table II gives the key conditions and results for 12 trials of the invention.

higher slag basicity, resulting in modestly higher Cr yield. This shows aluminum to be as effective as silicon in achieving a high Cr yield (98%).

Trial VIII compares with Trials III and V, indicating the effects of increased slag weight and higher ratio $O_2$/Ar of the injected gas as deteriorating Cr yield, to 75%. It is noted that neither Trial V, nor Trial VIII was followed by an argon only rinse. Trials IX and X, however, were followed by an Ar rinse of 3 to 5 minutes, which substantially improves Cr yield to 94% and 98%, respectively. In Trial IX, the initial bath Cr content was about 10%, but slag weight only about 50 kg/MT and ratio $O_2$Ar was relatively low. In Trial X, chromium was absent in the bath initially, as in all of the other trials except IX but the slag level was increased 6-fold to about 300 kg/MT and the ratio $O_2$/Ar of the injected gas was at the highest level of all the trials, just under five. In this

TABLE II

| TRIAL | I | II | III | IV | V | VI | VII | VIII | IX | X | XI | XII |
|---|---|---|---|---|---|---|---|---|---|---|---|---|
| ORE TYPE | CMI | CMI | CMI | CMI | CMI | CMI | CMI | CMI | CMI | CMI | CMI | CMI |
| ORE RATE (Kg/MT) | 25 | 40 | 44 | 37 | 89 | 39 | 35 | 130 | 43 | 192 | 64 | 64 |
| O2/Ar | 0 | 0 | 1.5 | 0.5 | 1.75 | 0.5 | 0.5 | 4.5 | 0.5 | 4.75 | 4.0 | 4.0 |
| TOTAL GAS FLOW (NM3/Min./MT) | 0.6 | 0.6 | 0.6 | 0.6 | 0.6 | 0.6 | 0.6 | 0.6 | 0.6 | 0.6 | 0.6 | 0.6 |
| AVG TEMP (C.) | 1438 | 1432 | 1479 | 1480 | 1462 | 1521 | 1487 | 1482 | 1494 | 1477 | 1415 | 1462 |
| SMELT TIME (MIN) | 14 | 7.7 | 19 | 13.5 | 21.6 | 16 | 18.25 | 44 | 16.5 | 71 | 20.5 | 24.0 |
| Ar RINSE (MIN) | — | — | 0 | 0 | 0 | 0 | 0 | 0 | 3 | 5 | 0 | 0 |
| INIT BATH % C | 1.58 | 1.94 | 1.94 | 1.35 | 1.23 | 1.91 | 1.72 | 1.46 | 1.94 | 1.74 | 0.29 | 1.80 |
| INIT BATH % Si | 0.02 | 1.77 | 1.82 | 1.01 | 2.15 | 0.22 | 1.17 | 2.23 | 1.18 | 5.58 | 0.48 | 0.91 |
| INIT BATH % Al | 0 | 0.07 | 0.16 | 0 | 0 | 0.83 | 0 | 0 | 0.01 | 0.03 | 0.05 | 0.11 |
| INIT BATH % Cr | 0 | 0 | 0 | 0 | 0 | 0 | 0 | 0 | 9.94 | 0 | 0 | 0 |
| FINAL BATH % C | 1.82 | 1.98 | 1.83 | 1.43 | 1.41 | 2.02 | 1.76 | 1.65 | 1.9 | 2.19 | 1.99 | 3.32 |
| FINAL BATH % Si | 0.02 | 1.48 | 1.11 | 0.0082 | 1.33 | 0.44 | 0.74 | 1.02 | 0.73 | 2.92 | 0.24 | 0.35 |
| FINAL BATH % Al | 0.01 | 0.01 | 0.01 | 0.01 | 0.01 | 0.01 | 0.01 | 0.05 | 0.01 | 0.02 | 0 | 0 |
| FINAL BATH % Cr | 0.55 | 1.15 | 1.37 | 1.22 | 2.12 | 1.25 | 1.09 | 2.68 | 10.83 | 5.6 | 1.48 | 1.88 |
| (CaO + MgO)/SiO2 | 1.6 | 1.4 | 0.95 | 1.8 | 1.8 | 2.8 | 2.6 | 2.1 | 1.6 | 1.6 | 1.0 | 1.0 |
| MgO/Al2O3 | 0.5 | 0.6 | 0.5 | 0.7 | 0.7 | 0.3 | 0.6 | 0.6 | 0.3 | 0.6 | 0.4 | 0.4 |
| SLAG WT (Kg/MT) | 31 | 44 | 48 | 40 | 97 | 48 | 42 | 199 | 48 | 295 | 40 | 53 |
| KgM OXY CONS/MT | 0.12 | 0.37 | 0.85 | 0.29 | 0.77 | 0.53 | 0.41 | 1.33 | 0.53 | 2.33 | 0.95 | 1.45 |
| % CONSUM BY C | 100 | 35 | 31 | 29 | 27 | 12 | 26 | 28 | 39 | 17 | 29 | 32 |
| % CONSUM BY Si | 0 | 56 | 59 | 71 | 73 | 0 | 74 | 65 | 61 | 83 | 67 | 63 |
| % CONSUM BY Al | 0 | 9 | 10 | 0 | 0 | 88 | 0 | 7 | 0 | 0 | 4 | 5 |
| SLAG % Cr2O3 | 3.9 | 1.15 | 0.7 | 3.7 | 5.2 | 2.7 | 0.5 | 6.2 | 2.1 | 1.1 | 2.4 | 3.0 |
| AVG. Cr YIELD | 79 | 99 | 99 | 96 | 84 | 97 | 98 | 75 | 94 | 98 | 98 | 96 |

Trial I illustrates that with carbon as the reductant and in the absence of injected oxygen, a Cr yield of about 79% is achievable in under 14 minutes, starting with pre-reduced chromite pellets at 54% Cr metallization. If silicon as well as carbon are the reductants, also in the absence of injected oxygen, the Cr yield improves considerably (to 99%), in less than eight minutes, as indicated by Trial II. Trial III illustrates that as oxygen is injected ($O_2$/Ar=1.5), a high Cr yield is still achievable in the presence of both carbon and silicon, but now requiring over twice as long (19 minutes). (Not shown for Trial III in Table II, the Cr yield is about 90% at eight minutes into the trial.)

Trial IV essentially repeats Trial III but for lower ratio of $O_2$/Ar of the injected gas and lower bath % Si. About the same Cr yield results (96%) for the equivalent smelting time (not shown in Table II is the Cr yield of 95% at 14 minutes into the trial).

Trial V demonstrates the negative effect of higher slag weight. For about the same bath % Si and % C, and ratio $O_2$/Ar of the injected gas as Trial III, doubling slag weight decreases Cr yield from 99% at 19 minutes into the trial to about 84% at 22 minutes into Trial V.

Trial VI also repeats Trial IV, but for aluminum rather than silicon as the co-reductant. Trial VII repeats Trial IV, but for trial, the pellets and slagging agents were not charged all at once but at 10 minute intervals to allow the heat-starved pilot reactor to reheat via combustion of silicon and carbon following each charge. The last batch was charged about 20 minutes from the end of the trial, including the Ar rinse, showing clearly that a high Or yield (98%) is possible despite the very high initial ratio $O_2$/Ar of the stirring means and the high slag weight when followed by the Ar rinse, the later, corresponding to Stage 3 of the present invention.

Finally, Trials XI and XII show at a low slag volume, a Cr yield above 95% is achievable at a high gas $O_2$/Ar, if some silicon is present at the end of the trial (about 0.3 wt. %). But, Trial X shows that at a high slag volume, a short Ar rinse is required to achieve a high Cr yield, despite much higher final silicon contents. During Trials XI and XII, some silicon (about three kg) was charged into the bath to generate needed heat by combustion but was nearly depleted by the end of the trial.

Examples For Commercial Operation Of The Invention

The present invention may be used to produce a variety of stainless steels using a reactor such as illustrated in FIG. 1, where a range of metallic Cr units can come directly from chromite ore. The balance of chromium may come from stainless steel scrap melted up-stream and possibly a minor amount of ferrochromium added as a trim addition after reduction has been completed. The number of metallic Cr units derived directly from the chromite depends on the process conditions chosen in the invention.

Ten examples are now presented to illustrate commercial applications proposed for the invention. Table III gives the operating conditions and consequences of Stage 1 of the invention where key parameters are varied. It is noted that application of the invention is not limited to the range of parameters selected. For example, the initial temperature of the iron bath can be a parameter, although in Table III, this is constant for all of the examples given. Also, for simplicity the examples are limited to production of a base alloy containing 10 wt. % Cr, 0.05 wt. % C and the balance Fe. This base alloy corresponds closely to AISI 409 stainless steel which can be easily made from the base alloy by trim additions. The invention may be employed to obtain higher chromium content in the bath, but there will entail higher slag weights, which will limit the maximum chromium content achievable. In Table III, the alloy produced in Stage 1 varies in Cr content depending on the conditions chosen. The differences in Cr content between the alloy produced in Stage 1 and the base alloy to be produced are adjusted by ferrochromium additions in Stage 3.

TABLE III

EXAMPLES FOR SMELTING CHROMITE IN STAGE 1
BASIS - 1 MT FE-CR-C ALLOY FROM STAGE 1

| EXAMPLE | A | B | C | D | E | F | G | H | I | J |
|---|---|---|---|---|---|---|---|---|---|---|
| REDUCTANT | C | C | C | C | C | C & Si | C & S | C & Si | C & Si | C & Si |
| IRON BATH COND | | | | | | | | | | |
| CHARGE (KG/MT) | 866 | 852 | 853 | 853 | 853 | 853 | 852 | 852 | 984 | 941 |
| % C | 1.5 | 1.5 | 1.5 | 1.5 | 1.5 | 1.5 | 1.5 | 1.5 | 1.82 | 3.89 |
| % Cr | 0 | 0 | 0 | 0 | 0 | 0 | 0 | 0 | 0 | 0 |
| % Fe | 98.5 | 98.5 | 98.5 | 98.5 | 98.5 | 98.5 | 98.5 | 98.5 | 98.2 | 96.1 |
| TEMPERATURE (F.) | 1600 | 1600 | 1600 | 1600 | 1600 | 1600 | 1600 | 1600 | 1600 | 1600 |
| CHROMITE COND | | | | | | | | | | |
| CHARGE (KG/MT) | 332 | 332 | 334 | 334 | 333 | 334 | 334 | 336 | 68 | 194 |
| % Cr-METALLIZED | 10 | 10 | 50 | 50 | 50 | 50 | 50 | 50 | 50 | 0 |
| % Fe-METALLIZED | 50 | 50 | 90 | 90 | 90 | 90 | 90 | 90 | 90 | 0 |
| CARBON | 20.7 | 22.8 | 17.5 | 16.5 | 16.3 | 12.6 | 8.9 | 13.3 | 4.3 | 0 |
| TEMPERATURE (F.) | 1200 | 1200 | 1200 | 1200 | 1200 | 1200 | 1200 | 1200 | 25 | 1200 |
| SLAGGING AGENTS | | | | | | | | | | |
| CaO (KG/MT) | 108 | 110 | 108 | 107 | 107 | 103 | 106 | 128 | 125 | 129 |
| $SiO_2$ (KG/MT) | 53 | 53 | 53 | 53 | 53 | 30 | 17 | 0 | 0 | 0 |
| MgO (KG/MT) | 0 | 0 | 0 | 0 | 0 | 0 | 0 | 3 | 33 | 18 |
| Al2O3 (KG/MT) | 0 | 0 | 0 | 0 | 0 | 0 | 0 | 0 | 36 | 16 |
| GAS CONDITIONS | | | | | | | | | | |
| % PCD | 25 | 25 | 25 | 25 | 30 | 25 | 25 | 0 | 0 | 0 |
| % HTE | 50 | 50 | 50 | 50 | 50 | 50 | 50 | 0 | 0 | 0 |
| O2/Ar | 9 | 9 | 9 | 9 | 9 | 9 | 9 | 4 | 4 | 4 |
| O2 CONSUM. (NM3/MT) | 115 | 131 | 81 | 76 | 78 | 57 | 42 | 46 | 12 | 28 |
| Ar CONSUM. (NM3/MT) | 13 | 15 | 9 | 8 | 9 | 7 | 5 | 12 | 3 | 7 |
| FINAL BATH COND | | | | | | | | | | |
| % C | 0.7 | 0.7 | 0.7 | 0.7 | 0.7 | 0.7 | 0.7 | 0.7 | 0.7 | 0.7 |
| % Si | 0 | 0 | 0 | 0 | 0 | 0 | 0 | 0 | 0 | 0 |
| % Cr | 7.5 | 8.9 | 8.7 | 8.7 | 8.7 | 8.8 | 8.8 | 8.8 | 1.5 | 5.1 |
| % Fe | 91.8 | 90.4 | 90.6 | 90.6 | 90.6 | 90.5 | 90.5 | 90.5 | 97.8 | 94.2 |
| Cr YIELD (%) | 73 | 87 | 85 | 85 | 85 | 85 | 85 | 85 | 85 | 85 |
| SLAGWEIGHT (KG/MT) | 273 | 277 | 273 | 272 | 271 | 265 | 269 | 309 | 300 | 300 |
| % CaO | 36.0 | 37.9 | 37.5 | 37.5 | 37.5 | 37.1 | 37.4 | 39.5 | 42.7 | 41.8 |
| % SiO2 | 24.0 | 25.3 | 25.1 | 25.0 | 25.0 | 24.7 | 24.9 | 26.3 | 28.5 | 27.9 |
| % MgO | 12.1 | 12.5 | 12.7 | 12.7 | 12.7 | 13.1 | 13.0 | 14.2 | 12.9 | 12.6 |
| % Al2O3 | 17.5 | 18.0 | 18.6 | 18.0 | 18.0 | 14.9 | 13.8 | 14.2 | 14.9 | 14.9 |
| % Cr2O3 | 9.6 | 5.2 | 5.8 | 5.8 | 5.8 | 6.0 | 5.9 | 5.2 | 1.0 | 3.2 |
| TEMPERATURE (C.) | 1600 | 1600 | 1600 | 1600 | 1600 | 1600 | 1600 | 1600 | 1600 | 1600 |
| TIME | | | | | | | | | | |
| DECARB RATE (% C/MIN) | 0.12 | 0.12 | 0.12 | 0.15 | 0.12 | 0.12 | 0.12 | 0.06 | 0.06 | 0.06 |
| DECARB TIME (MIN) | 55.3 | 60.8 | 45.0 | 33.1 | 40.6 | 29.2 | 19.2 | 67.4 | 20.5 | 23.0 |
| SILICON USE | | | | | | | | | | |
| SI CHARGE (KG/MT) | 0 | 0 | 0 | 0 | 0 | 9.6 | 16.3 | 29.7 | 38.1 | 35.0 |

In all examples, the smelting time necessary to reach the appropriate Cr yield is taken to be less than or equal to the decarburization time.

It is noted that the heat balance for Table III is maintained, as parameters are changed for each example, by adjustment of the weight percentage carbon in the charge or the initial wt. % C in the hot metal, which determines the decarburization time and heat generated by decarburization at the decarburization rate.

Table IV gives simple Si and Cr balances for all three stages, ending in production of the base alloy. Shown are the silicon consumption and resulting bath wt. % Cr in each stage. The Cr yield for Stage 1, which depends on pre-metallization degree, is given in Table III. No additional chromium loss to the slag is assumed in Stage 2. For Stage 3, a Cr yield of 97% is assumed for all examples. Any chromium deficiency needed to make the base alloy is made up by chromium aim in Stage 3.

Also shown in Table IV is an estimate of the savings in production costs calculated as a percentage of a base-line production cost that refers to a conventional operation, where the metallic Cr units are priced at $1.43 per kg Cr. In the base-line operation, the Cr units from stainless scrap and from ferrochromium are priced the same. For the examples of the invention, the price of the chromite ore, including shipping, is taken as $137.50 per MT ore. Finally Si is assumed to be $0.88 per kg. All other costs needed in the production cost calculation are based on prices assumed for the base-line operation.

TABLE IV

SI AND CR BALANCES FOR STAGES 1–3
BASIS: 1 MT OF ALLOY FROM STAGE 2

| EXAMPLE | A | B | C | D | E | F | G | H | I | J |
|---|---|---|---|---|---|---|---|---|---|---|
| STAGE 1 | | | | | | | | | | |
| Si CHARGE (KG/MT) | 0 | 0 | 0 | 0 | 0 | 9.6 | 16.3 | 29.7 | 38.1 | 35 |
| BATH Cr (%) | 7.5 | 8.9 | 8.7 | 8.7 | 8.7 | 8.8 | 8.8 | 8.8 | 1.5 | 5.1 |
| STAGE 2 | | | | | | | | | | |
| Si CHARGE (KG/MT) | 0 | 0 | 0 | 0 | 0 | 0 | 0 | 0 | 0 | 0 |
| BATH Cr (%) | 7.5 | 8.9 | 8.7 | 8.7 | 8.7 | 8.8 | 8.8 | 8.8 | 1.5 | 5.1 |
| STAGE 3 | | | | | | | | | | |
| Si CHARGE (KG/MT) | 11.9 | 5.1 | 5.0 | 5.0 | 5.3 | 5.0 | 5.0 | 5.0 | 0.9 | 4.1 |
| BATH Cr (FROM ORE, % ) | 9.9 | 9.9 | 10.0 | 10.0 | 10.0 | 10.0 | 10.0 | 10.0 | 1.8 | 5.8 |
| Cr TRIM (KG/MT) | 2.9 | 1.3 | 1.1 | 1.0 | 1.1 | 0.8 | 0 | 0.4 | 91.0 | 46.9 |
| FINAL BATH Cr (%) | 10 | 10 | 10 | 10 | 10 | 10 | 10 | 10 | 10 | 10 |
| TOTAL Si (KG/MT) | 11.9 | 5.1 | 5.0 | 5.0 | 5.0 | 14.6 | 21.3 | 34.7 | 39.0 | 39.1 |
| EST SAVINGS IN PROD COSTS (%) | 16.2 | 17.9 | 21.4 | 22.1 | 21.8 | 21.1 | 20.9 | 14.3 | −15.3 | 0.5 |

EXAMPLES A and B

In these two examples of the invention using a reactor such as illustrated in FIG. 1, the impact of an increase in chrome yield of the total chromium in Stage 1 from 73% to 87% is shown. All other parameters are constant, except % fixed carbon of the pre-reduced chromite charge. Post-combustion degree and heat transfer efficiency are set at 25 and 50%, respectively. The chromite charge rate is also the same for both examples, which is at the level to result in the base alloy in Stage 3.

The higher chrome yield corresponds to an increased carbon requirement because more carbon is needed to smelt chromite to achieve the higher chrome yield for the same pre-metallization degree. Because reduction of chromite by carbon is endothermic, additional carbon has to be decarburized to satisfy the heat balance. This results in a somewhat longer decarburization time. It is noted for both examples, the decarburization time is excessively long, e.g., about one hour, compared to the time required for simultaneous smelting as indicated from the pilot trial result, e.g., about 20 minutes.

The chrome level of the alloy produced in Stage 1 increases with Cr yield. Slag weight increases modestly but in either case is well below 400 kg slag/MT, and is not a limiting factor. In Stage 3, more silicon is charged for Example A than Example B to recover the larger amount of unreduced chromite from Stage 1 in the former case. Nonetheless, the impact on the production cost savings is modest, reducing it by about 2%.

EXAMPLES A and C

In these two examples, the pre-metallization degree of the chromite ore is varied to reflect the impact of pre-reduction. The pre-reduction step might be by a kiln or a rotary hearth furnace where chromite ore is mixed with carbonaceous material and partially metallized in the solid state. All other parameters are constant, except % fixed carbon of the pre-reduced chromite charge. This decreases with increasing metallization degree, as less carbon is required as a reductant for smelting. As a result, decarburization time is decreased substantially.

In Examples A and C, Cr yield of the chromite smelted in Stage 1 is the same (70%). However, since the chromite charged in Example C is more highly metallized than in Example A, the net Cr yield for all chrome in Stage 1 is increased from 73% to 85%. As a result, the Cr level of the alloy produced in Stage 1 increases. Also, in Stage 3, less silicon is needed to recover the smaller amount of unreduced chromite from Stage 1. Increased pre-metallization degree and accompanying high Cr yield has a big impact on production costs. Example C shows the higher production cost savings at about 21%.

EXAMPLES C and D

Example D is compared to Example C, wherein the decarburization rate is increased to 0.15% C/min from 0.12% C/min. The biggest impact in Stage 1 is on the decarburization time and the heat balance as a result of less heat losses over the shorter decarburization time. As a result, decarburization decreases from 45 to 33 minutes and the % fixed carbon with the chromite declines modestly from 17.5 to 16.5 wt. %.

In Stage 3, about the same amount of silicon is consumed for the two examples, but production cost savings increases to the highest of all the scenarios, e.g., 22%, mainly as a result of less refractory wear.

EXAMPLES C and E

In these two examples, % PCD is varied as a parameter, all else constant. The increase in PCD from 25% to 30%, keeping HTE constant at 50%, has a modest impact on carbon requirement for the heat balance and, consequently, on decarburization time. Also, since in Stage 3 about the same amount of silicon is consumed for these two examples, production cost savings increases very modestly by about ½%.

EXAMPLES C, F, and G

Example F is the first of several examples in Table III having silicon as a co-reductant in Stage 1, to be compared to Example C, where all other key parameters are the same. The biggest impact is in the heat balance now dictating less carbon for decarburization heat and as a result, less accompanying ash. This significantly lowers decarburization time from about 45 minutes to about 29 minutes, a 35% reduction. Surprisingly, slag weight decreases modestly despite the contribution of additional $SiO_2$ and CaO to the slag. However, there is significantly less slag from a lower carbon rate.

The significantly higher silicon usage of Example F compared to Example C, however, does not adversely impact production cost savings, showing about the same level. This is due to lower decarburization time, off-setting higher silicon usage at the price assumed for silicon relative to chrome (assumed to be about 60% of the pi-ice of Cr in ferrochrome, kg for kg).

In Example G, increasingly more silicon substitutes for carbon as a reductant than in Example F, where 16.3 kg Si is charged in Stage 1 compared with 9.6 kg Si/MT. As a result, % fixed carbon is reduced from 17.5% (Example C) to 12.6% (Example F) to 8.9% (Example G). Correspondingly, decarburization time is decreased from 45 minutes (Example C) to 29 minutes (Example F) to 19 minutes (Example G). Though total silicon consumption is up substantially in Example G as compared to Example C, production cost savings remain virtually unchanged at the price assumed for Si relative to Cr.

EXAMPLES C, F, and H

While in both Examples F and H, silicon is a co-reductant along with carbon, PCD is taken to be zero for the latter, corresponding to the absence of any decarburization and post-combustion from a top lance. Unlike Examples A–G using a top lance, Example H corresponds to the case of no top lance for either post-combustion and decarburization. The decarburization rate is reduced by 50% to 0.06% C/min because decarburization occurs by using only bottom tuyeres. To make-up for the loss of heat from post-combustion in the heat balance, silicon consumption is increased dramatically, with a modest increase in carbon consumption. As a result, slag weight is also increased substantially to 309 kg/MT. Decarburization time increases dramatically to over an hour, increasing the heat load from heat losses. The combination of all these changes reduces production cost savings to 14%.

EXAMPLES I and J

Examples I and J refer to significantly different process configurations compared to the earlier examples. In Example I, the chromite is partially metallized but is delivered cold to a TBRR. This might correspond to the case where a pre-reducer is not located at the melt shop. In Example J, unreduced chromite concentrate is charged hot into the TBRR. This is a case where an inexpensive kiln is used simply to pre-heat but not metallize the charge materials. In both examples I and J, PCD again is zero because a top lance is not used and the decarburization rate is low, where decarburization is totally via bottom tuyeres. Silicon is a major reductant along with carbon with the latter being dissolved into the iron metal charge upstream in an EAF.

Both examples quickly reach a high slag volume which limits the total chromite charge weight. A slag volume of 300 kg/MT is taken as the limit for these two examples. Decarburization times are short, e.g., about 20–25 minutes, but can be extended by decreasing the Si/C reductant ratio. Under the assumption that a chrome yield of 85% can be achieved within the decarburization time, the bath chrome level from the chromite is significantly lower for these two examples, e.g., 1.5% and 5.1% for Examples I and J, respectively. Because fewer chrome units per tonne of 10 wt. % Cr alloy are supplied in these examples from inexpensive chromite along with a high silicon consumption, the savings in production costs are decreased significantly. The savings in production costs are barely significant for Example J and significantly negative for Example I.

It will be understood various modifications can be made to the invention without departing from the spirit and scope of it. Therefore, the limits of the invention should be determined from the appended claims.

What is claimed is:

1. A method of producing stainless steel by smelting metal oxide insitu in a refining reactor, comprising the steps of:

providing an iron/slag bath mixture within the reactor, the iron bath containing dissolved carbon, the reactor including means for bottom-stirring the iron bath, charging an oxygen-bound chromium metal into the iron bath, injecting an oxygen-containing gas through the stirring means to effect decarburization and vigorously stirring the iron bath, slag, and oxygen-bound metal thereby forming a chromium alloy bath having the carbon reduced to its final specification, charging a metalloid reductant into the reactor, and injecting a non-oxidizing gas through the stirring means to rinse the alloy bath until dynamic equilibrium is sustained and chromium yield is maximized.

2. The method of claim 1 wherein the reactor includes means for top-blowing of oxygen and the additional step of passing oxygen gas through the blowing means into the reactor, a portion of the oxygen gas being discharged above the iron bath to effect post-combustion of CO and $H_2$ and the remainder of the oxygen gas being injected into the iron bath to effect decarburization of carbon in the iron bath to CO.

3. The method of claim 2 wherein the oxygen gas is essentially pure oxygen.

4. The method of claim 1 wherein the oxygen-containing gas is from the group consisting essentially of air, oxygen-enriched air, pure oxygen, water, steam or a mixture thereof.

5. The method of claim 4 wherein the oxygen-containing gas additionally includes Ar, $N_2$ or a mixture thereof.

6. The method of claim 2 wherein the total specific flow of oxygen gas passing through the blowing means and oxygen-containing gas passing through the stirring means is at least 0.5 $NM^3$/min/MT.

7. The method of claim 2 wherein the total specific flow of gas passing through the blowing means and gas passing through the stirring means is 2 to 4 $NM^3$/min/MT.

8. The method of claim 2 wherein 30–60% of the total gas flow into the reactor is through the stirring means.

9. The method of claim 2 wherein the gas passed through the blowing means is essentially pure oxygen and the gas injected through the stirring means has an oxygen to non-oxidizing molar gas ratio less than 4.

10. The method of claim 2 wherein the post-combustion degree of CO and $H_2$ is less than 50%.

11. The method of claim 10 wherein the post-combustion degree of CO and $H_2$ is 20–30%.

12. The method of claim 2 wherein during post-combustion the initial molar ratio of oxygen to non-oxidizing gas in the stirring gas is 4/1.

13. The method of claim 12 wherein the molar ratio of oxygen to non-oxidizing gas with the oxygen in the stirring gas is decreased to 1/1 by the end of decarburization.

14. The method of claim 13 wherein the molar ratio of oxygen to non-oxidizing gas in the stirring gas is decreased to about ⅓ by the end of decarburization.

15. The method of claim 2 wherein the temperature of the iron bath prior to the oxygen-blow is 1500° C. to 1750° C.

16. The method of claim 2 wherein the alloy bath contains 0.5–1.5 wt. % C, at least 2.0 wt. % Cr and the chromium yield of the total chromium is at least 70% at the end of post-combustion.

17. The method of claim 1 wherein the oxygen-bound metal includes chromium oxide at least 10% metallized and iron oxide at least 50% metallized.

18. The method of claim 1 wherein the oxygen-bound metal is a chromite ore concentrate containing between 25 and 55% $Cr_2O_3$, the balance FeO, MgO, $SiO_2$, $Al_2O_3$ and CaO and wherein the weight ratio of Cr to Fe is between 0.9 and 3.5.

19. The method of claim 1 wherein the oxygen-bound metal is preheated to at least 1000° C.

20. The method of claim 1 wherein the oxygen-bound metal includes a carbonaceous reductant, a metalloid reductant and slagging agents.

21. The method of claim 20 wherein the metalloid reductant is silicon.

22. The method of claim 1 wherein the oxygen-bound metal contains solid carbon of a quantity in excess of that required for pre-metallization of the oxygen-bound metal.

23. The method of claim 2 wherein at least one of a solid carbonaceous reductant and a metalloid reductant is added into the initial iron bath.

24. The method of claim 1 wherein the initial iron bath contains 0–15 wt. % Cr and 0.5 wt. % C up to carbon saturation.

25. The method of claim 1 wherein in the slag basicity is maintained between 1.0–3.0.

26. The method of claim 1 wherein the weight ratio of $MgO/Al_2O_3$ in the slag is maintained between 0.3–0.8.

27. The method of claim 1 wherein the slag weight, excluding $Cr_2O_3$ or FeO, during post-combustion does not exceed 400 kg/MT.

28. The method of claim 27 wherein the slag weight does not exceed 300 kg/MT.

29. The method of claim 1 including the additional step of adding ferrochromium to the alloy bath to make the final chromium specification.

30. The method of claim 1 wherein at least 20% of the total chromium of the final alloy bath is derived from the chromite of the charge materials.

31. The method of claim 1 wherein the iron bath is melted from one or more solid iron materials from the group consisting of carbon steel scrap, stainless steel scrap, direct reduced iron, hot-briquetted iron, iron carbide and steel plant wastes.

32. The method of claim 31 including the additional step of providing a melting furnace for melting the iron bath from the solid iron materials.

33. The method of claim 1 wherein the iron bath is produced in an iron smelting furnace from solid iron or iron oxide containing materials.

34. The method of claim 1 wherein the oxygen-bound metal is from the group consisting of raw chromite ore, chromite ore concentrate, metallized chromite ore and chromium oxide-containing steel plant wastes.

35. The method of claim 1 wherein the reactor is an AOD and the oxygen content of the stirring gas is reduced as the carbon content of the alloy bath approaches its final carbon specification.

36. The method of claim 1 wherein the reactor is a VOD and the carbon content of the alloy bath is reduced by reducing the partial pressure of oxygen in the bath.

37. The method of claim 2 wherein the flow rate of post-combustion oxygen is controlled independently of the flow rate of decarburization oxygen.

38. The method of claim 2 wherein the blowing means includes a lance having a pair of gas passages, the post-combustion oxygen flowing through one of the passages and the decarburization oxygen passing through the other of the passages.

39. The method of claim 37 wherein the post-combustion oxygen passage includes a plurality of nozzles and the decarburization oxygen passage includes one nozzle.

40. A method of producing stainless steel by smelting metal oxide insitu in a top-and bottom-blowing refining reactor, comprising the following stages:

Stage 1—providing a carbon-containing iron/slag bath mixture in the reactor, the reactor including means for top-blowing of oxygen and means for bottom-stirring the iron bath, charging an oxygen-bound metal, a carbonaceous material and slagging agents into the reactor, passing oxygen gas through the blowing means, a portion of the oxygen gas being discharged above the iron bath to effect post-combustion of CO and $H_2$ and the remainder of the oxygen gas being injected into the iron bath to effect decarburization of carbon in the iron bath to CO, injecting an oxygen-containing gas through the stirring means to effect decarburization in the iron bath and vigorous mixing of the iron bath, slag, and oxygen-bound metal thereby forming a chromium alloy bath, Stage 2—discontinuing passing the oxygen gas through the blowing means thereby ceasing post-combustion and decarburization, and reducing the carbon content of the alloy bath to its final carbon specification, and Stage 3—charging a metalloid reductant into the reactor and injecting a non-oxidizing gas through the stirring means to rinse the alloy bath until dynamic equilibrium is sustained and chromium yield is maximized.

41. A method of producing stainless steel by smelting metal oxide insitu in a refining reactor, comprising the steps of:

providing an iron/slag bath mixture containing at least 0.5 wt. % C and having a temperature of at least 1500° C. in the reactor, the reactor including means for top-blowing of oxygen and means for bottom-stirring the molten iron, charging chromite, a carbonaceous material and slagging agents into the iron bath, passing oxygen gas through the blowing means, a portion of the oxygen gas being discharged above the iron bath to effect post-combustion of CO and $H_2$ wherein the post-combustion degree is less than 50% and injecting the remaining portion of the oxygen gas into the bath to effect decarburization in the iron bath to CO, injecting an oxygen-containing gas through the stirring means to effect decarburization in the iron bath and vigorous mixing of the iron bath, slag, and chromite to decarburize the bath thereby forming a chromium alloy bath containing no greater than 1.5 wt. % C, at least 2 wt. % Cr and having a temperature no greater than 1750° C. at the end of post-combustion, discontinuing passing the oxygen gas through the blowing means thereby ceasing post-combustion and decarburization, and then decreasing the oxygen content of the stirring gas as the carbon content of alloy bath approaches its final carbon specification, and charging a metalloid reductant into the reactor and injecting a non-oxidizing gas through the stirring means to rinse the alloy bath until dynamic equilibrium is sustained and chromium yield is maximized.

42. A method of producing stainless steel by smelting metal oxide insitu in a refining reactor, comprising the steps of:

providing an iron/slag bath mixture containing at least 0.5 wt. % C and having a temperature of at least 1500° C. in the reactor, the reactor including a top lance and means for stirring the molten iron, charging a concentrate produced from a chromite ore, a solid carbonaceous reductant and slagging agents into the iron bath, the concentrate containing at least 25 wt. % $Cr_2O_3$ and at least 7 wt. % FeO, the chromium oxide of the concentrate being at least 10% metallized and the iron oxide of the concentrate being at least 50% metallized, passing oxygen gas through the lance, the lance discharging a portion of the oxygen gas above the bath to effect post-combustion of CO and $H_2$ wherein the post-combustion degree is less than 50% and the lance injecting the remaining portion of the oxygen gas into the bath to effect decarburization, injecting an oxygen-containing gas through the stirring means to effect decarburization in the iron bath and vigorous mixing of the iron bath, slag, and chromite concentrate to decarburize the bath thereby forming a chromium alloy bath containing 0.5–1.5 wt. % C, at least 5 wt. % Cr and having a temperature no greater than 1750° C. after post-combustion, discontinuing passing the oxygen gas through the lance thereby ceasing post-combustion and decarburization via the lance, and then decreasing the oxygen content of the stirring gas as the carbon content of alloy bath approaches its final carbon specification, charging a metalloid reductant into the reactor and injecting a non-oxidizing gas through the stirring means to rinse the alloy bath until dynamic equilibrium is sustained wherein at least 50% of the chromium in the alloy bath is from the chromite concentrate.

43. A method of producing stainless steel by smelting metal oxide insitu in a refining reactor, comprising the steps of:

providing an iron/slag bath mixture containing at least 0.5 wt. % C and having a temperature of at least 1500° C. in the reactor, the reactor including a top lance and means for bottom-stirring the iron bath, charging an oxygen-bound metal, at least one of a solid carbonaceous or metalloid reductant and slagging agents into the iron bath, passing oxygen gas through the lance, the lance having a pair of gas passages, the lance discharging a portion of the oxygen gas through one of the passages above the bath to effect post-combustion of CO and $H_2$ wherein the post-combustion degree is less than 30% and the lance injecting the remaining portion of the oxygen gas through the other of the passages into the bath to effect decarburization, injecting a gas through the stirring means to effect decarburization and vigorous mixing of the iron bath, slag, and oxygen-bound metal thereby forming a chromium alloy bath containing 0.5–1.5 wt. % C, at least 8 wt. % Cr and having a temperature no greater than 1750° C. after post-combustion, the stirring gas being a mixture of oxygen and a non-oxidizing gas, the total specific flow of oxygen gas flowing through the lance and oxygen-containing gas flowing through the stirring means being 2 to 4 $NM^3$/min/MT, discontinuing passing the oxygen gas through the lance thereby ceasing post-combustion and decarburization via the lance, and then decreasing the oxygen content of the stirring gas as the carbon content of the alloy bath approaches its final carbon specification, the molar ratio of oxygen to non-oxidizing gas in the stirring gas being no greater than 4/1 during post-combustion, charging a metalloid reductant into the reactor, and injecting a non-oxidizing gas through the stirring means to rinse the alloy bath until dynamic equilibrium is sustained wherein the chromium yield of the oxygen-bound metal is at least 97% and at least 80% of the chromium in the alloy bath is from the chromite concentrate.

* * * * *